US006116226A

United States Patent [19]

Vogel

[11] Patent Number: 6,116,226

[45] Date of Patent: Sep. 12, 2000

[54] INDUCTIVE IGNITION DEVICE

[75] Inventor: Manfred Vogel, Ditzingen, Germany

[73] Assignee: Robert Bosch GmbH, Stuttgart, Germany

[21] Appl. No.: 08/952,991

[22] PCT Filed: Nov. 20, 1996

[86] PCT No.: PCT/DE96/02209

§ 371 Date: Nov. 18, 1997

§ 102(e) Date: Nov. 18, 1997

[87] PCT Pub. No.: WO97/35109

PCT Pub. Date: Sep. 25, 1997

[30] Foreign Application Priority Data

Mar. 20, 1996 [DE] Germany ..... 196 10 862

[51] Int. Cl.[7] ..... F02P 9/00

[52] U.S. Cl. ..... 123/609; 123/655

[58] Field of Search ..... 123/606, 609, 123/655

[56] References Cited

U.S. PATENT DOCUMENTS

| | | | |
|---|---|---|---|
| 4,556,040 | 12/1985 | Heyke | 123/655 |
| 5,265,580 | 11/1993 | Vogel et al. | 123/655 |
| 5,293,129 | 3/1994 | Ikeuchi et al. | 123/655 |
| 5,379,745 | 1/1995 | Vogel et al. | 123/655 |
| 5,771,871 | 6/1998 | Vogel et al. | 123/655 |

*Primary Examiner*—Erick R. Solis
*Attorney, Agent, or Firm*—Kenyon & Kenyon

[57] ABSTRACT

An inductive ignition device for spark plugs of an internal combustion engine is having at least one activation circuit for at least one ignition coil and having at least one spark plug. A high-voltage switch associated with the at least one spark plug is brought by a first activation signal of the activation circuit into a conductive, switched-on state. In the switched-on state, the high-voltage switch has passing through it the spark current ($I_2$) of the at least one spark plug (3; 3*a* to 3*n*), and which is designed so that without further activation it remains in the conductive state until the spark current falls below a certain value (holding current).

19 Claims, 4 Drawing Sheets

INDUCTIVE IGNITION DEVICE

FIELD OF THE INVENTION

The present invention relates to an inductive ignition device for spark plugs of an internal combustion engine, and also to a method for activating a spark plug of an internal combustion engine.

BACKGROUND INFORMATION

Inductive ignition devices of the type discussed here are known. They can have single spark coils or can be equipped with an electronic high-voltage distributor. Methods of the aforesaid type are also known. When an internal combustion engine is operating at high speeds, it is often problematic to perform an ionization current measurement. This measurement is the basis on which the combustion characteristics of the internal combustion engine can be monitored. It has also been found that in this operating state, the energy provided for a discharge operation cannot be completely dissipated via a spark plug, but rather that residual energy is present after completion of the ignition operation, which can cause the power dissipation in the ignition device to rise sharply. Attempts have already been made to provide a current limiter in the ignition output stage of the ignition device, or to implement a current limiter by way of primary resistors. In both cases, however, the result is high power dissipation in the ignition output stage or in the ignition coil. Attempts have also been made to decrease the ignition coil energy by reducing the dwell time at high engine speeds. The problem which has occurred here, however, is that sufficient availability of voltage and energy cannot be guaranteed under all operating conditions.

SUMMARY OF THE INVENTION

The inductive ignition device and method according to the present invention eliminate the disadvantages mentioned above. Provision is made for an ionization current measurement to be made with no need to decrease the available voltage or the secondary initial current that is conveyed to the spark plug. In addition, a "residual energy mode" is avoided in multiple-cylinder engines, even at high engine speeds and even when activation is provided with only one output stage. In the context, at a given energy the spark plugs can be activated with a low initial current, resulting in low spark plug wear.

DETAILED DESCRIPTION

Figure 1:
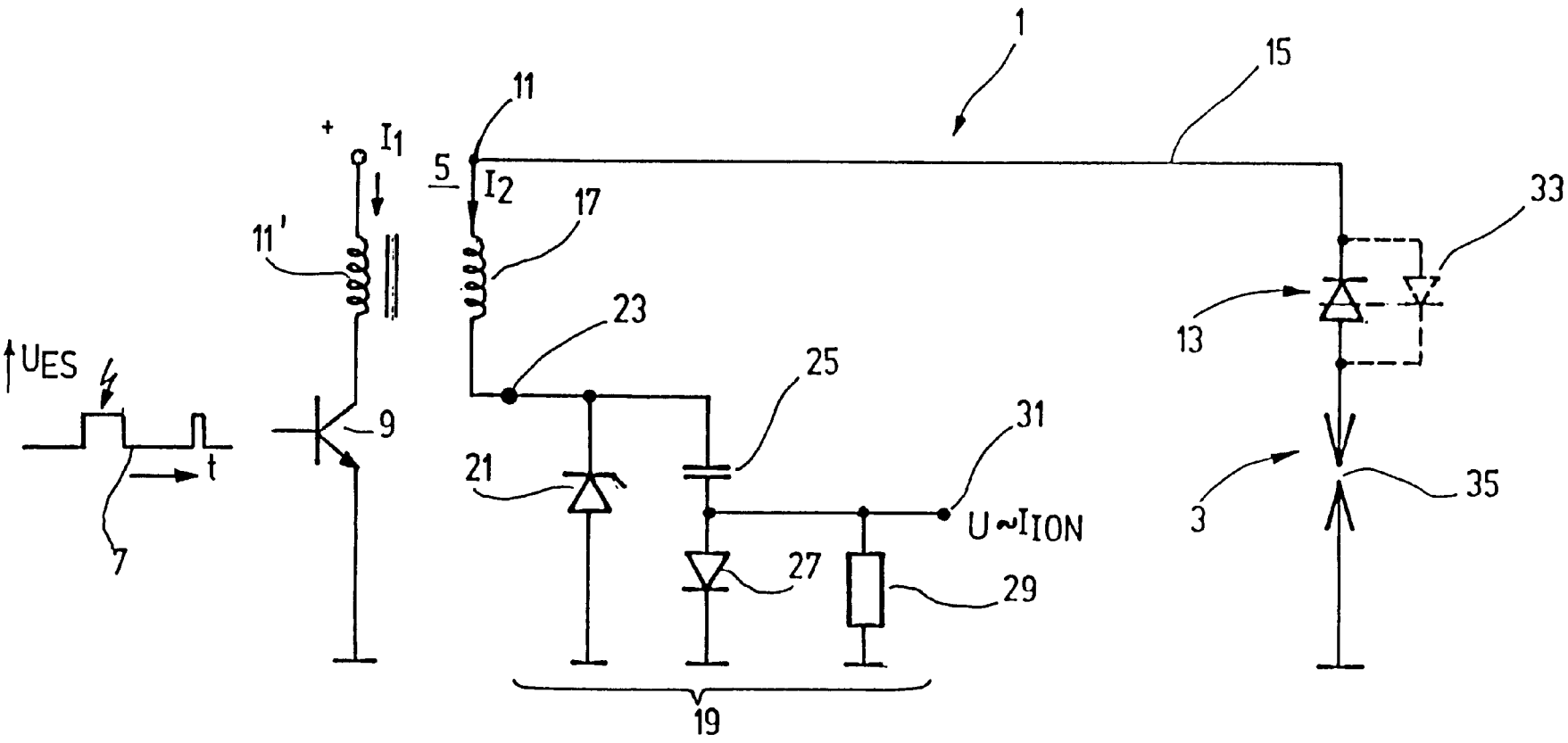
FIG. 1 shows a first exemplary embodiment of an inductive ignition device, having a single spark coil for each spark plug according to the present invention.

FIG. 1 shows a schematic circuit diagram of an inductive ignition device 1 in which there is associated with each spark plug 3 of an internal combustion engine, an ignition coil 5 (also referred to as a single spark coil) that can be activated via an ignition output stage, of which only the activation signal 7 over time, which is sent to a switching device (in this case a transistor 9), is indicated here.

Provided on the primary side of ignition coil 5 is a primary winding 11' which is connected on the one hand to a voltage source (labeled with a plus sign) and on the other hand via transistor 9 to ground. Provided on the secondary side of ignition coil 5, at its high-voltage output 11, is a high-voltage switch 13 which is arranged in connecting path 15 between high-voltage output 11 and spark plug 3. Winding 17 of the secondary side of ignition coil 5, connected to high-voltage output 11, is on the other hand grounded via a measurement circuit 19. Measurement circuit 19 comprises a Zener diode 21 connected at its cathode to a connection point 23 and at its anode to ground. Connected between connection point 23 and ground, parallel to Zener diode 21, is a series circuit made up of a capacitor 25 and a diode 27, the cathode of which is connected to ground and the anode of which is connected to capacitor 25. Connected respectively to the anode of diode 27 and to capacitor 25 is a resistor 29 which is additionally connected to ground. Resistor 29 is thus parallel to diode 27. At the connecting point between diode 27 and capacitor 25, to which resistor 29 is also connected, there results a measurement voltage output 31 at which a voltage proportional to the ionization current can be measured.

An ignition coil 5, and preferably also a measurement circuit 19, are provided for each spark plug 3.

The core of inductive ignition device 1 is high-voltage switch 13, which is provided on the secondary side of ignition coil 5 and is configured here as a high-voltage flip-flop diode, of which the cathode is connected to high-voltage output 11, and the anode to spark plug 3. A diode 33 of opposite polarization, located parallel to the high-voltage switch and drawn with dashed lines, indicates that high-voltage switch 13 is configured to conduct in the reverse direction. When the high-voltage switch 13 is switched off, diode 33 also allows a positive potential to pass from high-voltage output 11 and via connecting path 15 to spark gap 35 of spark plug 3. The positive potential U is applied via capacitor 25 to spark gap 35 so that an ionization current $I_{ION}$ can be measured in known fashion. This ionization current provides information about the combustion process, in particular about knocking of the cylinder associated with spark plug 3, and about the combustion occurring the combustion chamber.

The current flowing on the primary side of ignition coil 5 through transistor 9 is designated $I_1$; the current flowing on the secondary side is designated $I_2$. The activation signal applied to the base of transistor 9, which derives from an output stage activation system (not depicted here), is designated $U_{ES}$. A lightning-bolt symbol indicates the moment of ignition.

Figure 2:
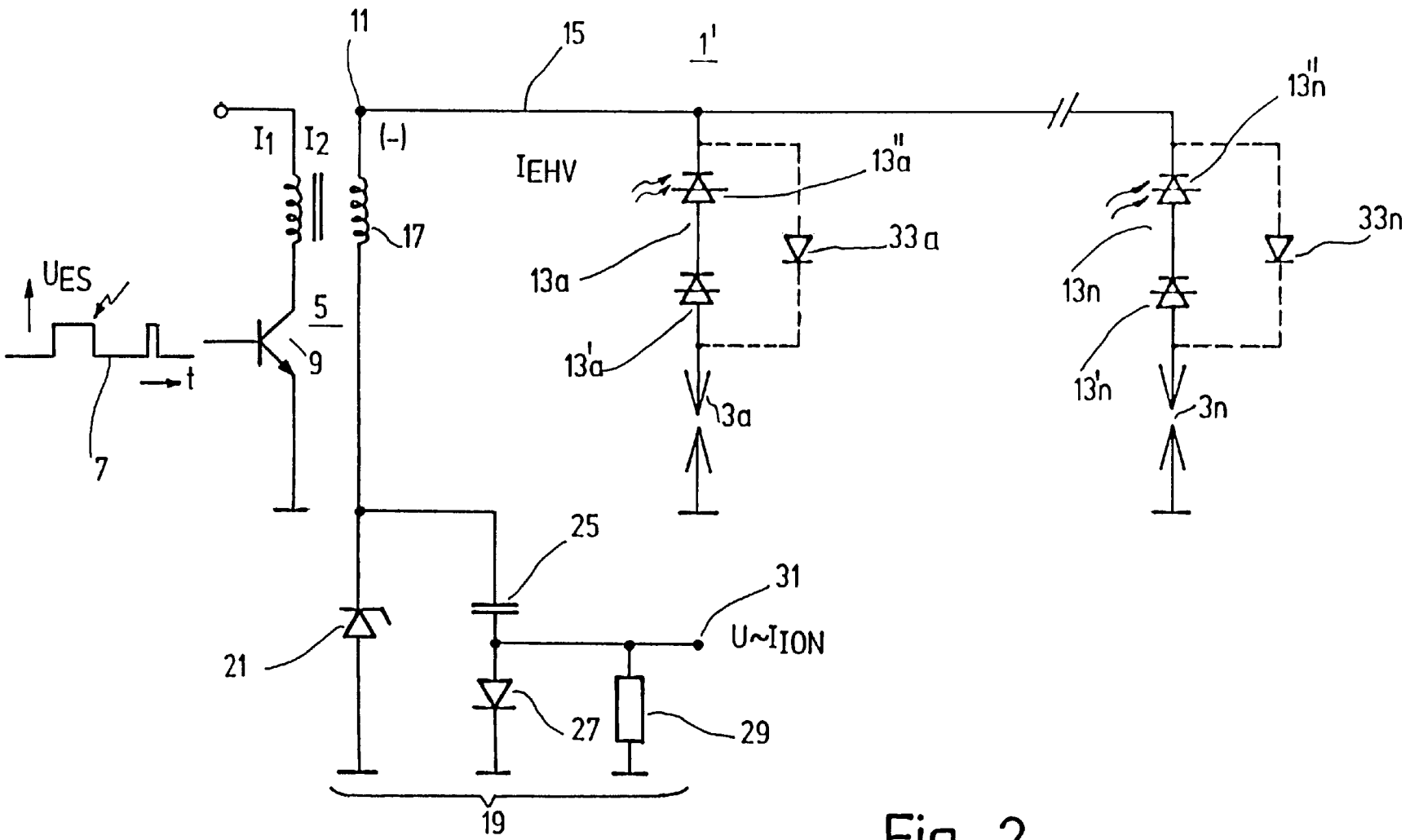
FIG. 2 shows a first exemplary embodiment of an inductive ignition device having an electronic high-voltage distributor according to the present invention.

Inductive ignition device 1', which is depicted in FIG. 2, has fundamentally the same components as the ignition device in FIG. 1. Identical parts have been given the same reference characters.

In inductive ignition device I' as shown in FIG. 2, an activation signal 7 of an output stage activation system (not depicted here) is applied to a switch (here indicated once again as transistor 9) which activates a single ignition coil 5 to which the multiple spark plugs 3*a* to 3*n*, arranged in parallel, can be connected. Spark plugs 3*a* to 3*n* are connected, each via a high-voltage switch 13*a* to 13*n*, via a connecting path 15 between high voltage output 11 on the secondary side of ignition coil 5 and ground. A separate high-voltage switch is associated with each spark plug. Diodes 33*a* to 33*n* arranged parallel to high-voltage switches 13*a* to 13*n*, drawn with dashed lines, indicate that the high-voltage switches 13*a* to 13*n* are configured to conduct in the reverse direction.

The energy of ignition coil 5 is distributed (electronically) to spark plugs 3*a* to 3*n* by means of corresponding activation of the high-voltage switches. FIG. 2 thus shows an ignition device having an electronic high-voltage distributor.

A measurement circuit 19 identical in configuration to the one depicted and explained with references to FIG. 1 is once again provided on the secondary side of ignition coil 5, at the end of winding 17 opposite high-voltage output 11. Reference is therefore made to the statements in connection with FIG. 1.

A current $I_1$ flows on the primary side of ignition coil 5; a current $I_2$, which is passed on via high-voltage switches 13*a* to 13*n* to the respective spark plugs 3*a* to 3*n*, flows on the secondary side. Ignition coil 5 is once again activated via an activation signal 7, labeled $U_{ES}$, of an output stage activation system (not depicted here) that is applied to the base of transistor 9. A lightning-bolt symbol once again indicates the moment of ignition.

High-voltage switch 13*a* to 13*n* is here, purely by way of example, configured as a light-triggered flip-flop diode which comprises an overhead-switched high-voltage diode 13'*a* to 13'*n* and a light-controlled switch 13"*a* to 13"*n*. The light-controlled switch can be controlled via a light signal that is generated by a suitable light emission element, for example a light-emitting diode. The light required to trigger conductivity is indicated by two wavy arrows. The current necessary for generation of the light is labeled $I_{EHV}$.

Inside the high-voltage switch (e.g. 13*a*), the two diodes—i.e. the light controlled switch 13"*a* and the overhead-switched switch 13'*a*—are connected in series, the anode of overhead-switched switch 13'*a*/13'*n* being connected to spark plug 3*a*/3*n*, and its cathode to the anode of light-controlled switch 13"*a*/13"*n*. The cathodes of the light-controlled switches are connected via connecting path 15 to high-voltage output 11 of ignition coil 5. FIG. 2 indicates that spark plugs 3*a* to 3*n* are activated with a negative potential. Light-triggered flip-flop diodes 13*a* to 13*n* are, as mentioned above, configured to conduct in the reverse direction, i.e. they are conductive at a certain positive measured potential (the charge of capacitor 25), so that the ionization current $I_{ION}$ present across the spark gap of spark plugs 3*a* to 3*n* can be sensed. The measurement voltage used for the ionization current measurement is 100 V to 500 V, preferably 200 V to 300 V. This applies to all the circuit variants.

Figure 3:
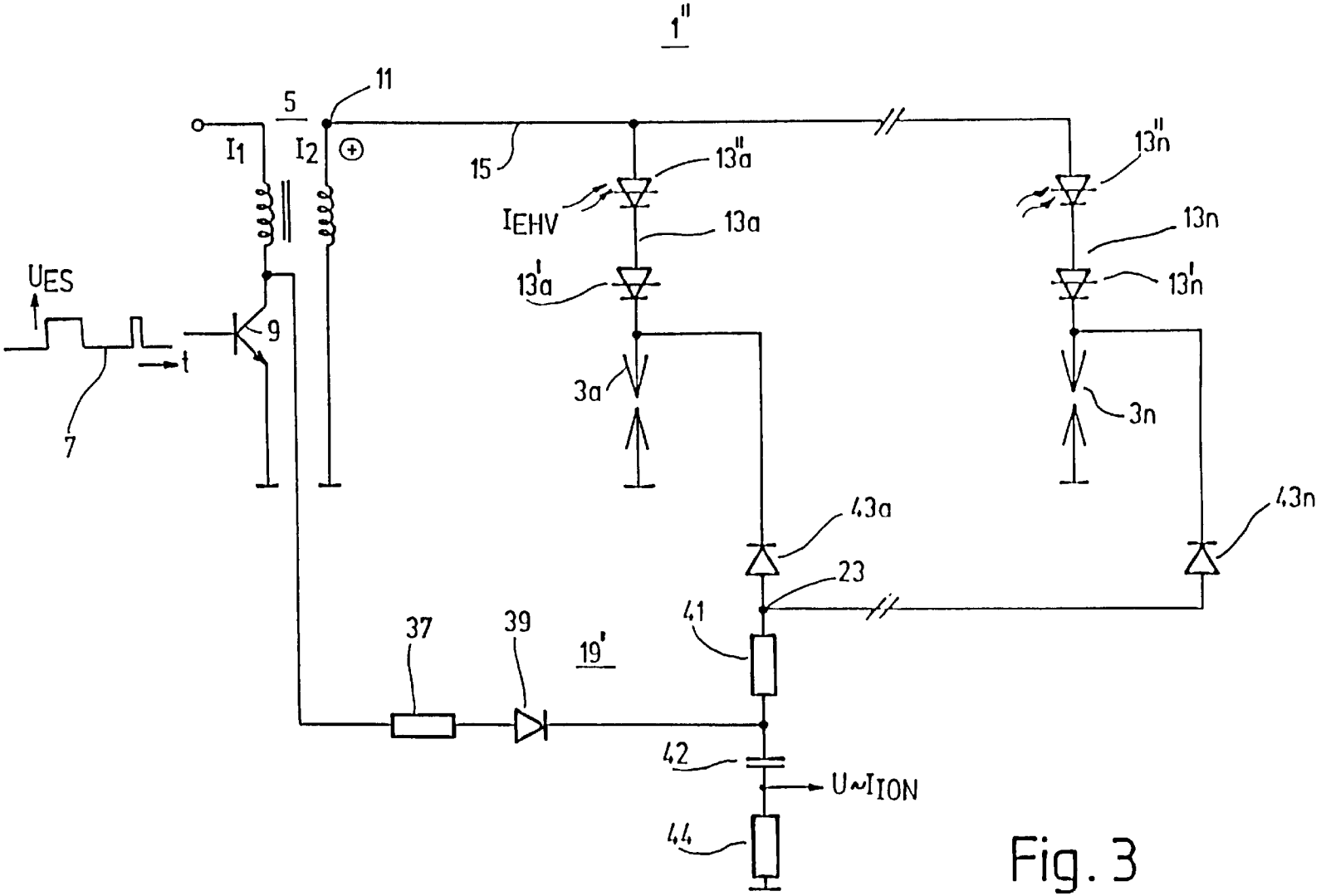
FIG. 3 shows a second exemplary embodiment of an inductive ignition device having an electronic high-voltage distributor according to the present invention.

FIG. 3 shows an alternative embodiment of inductive ignition device 1' with an electronic high-voltage distributor depicted in FIG. 2. Ignition device 1" in FIG. 3 differs exclusively in that spark plugs 3*a* to 3*n* are activated with a positive potential, which is applied to spark plugs 3*a* to 3*n* via high-voltage output 11 and connecting path 15, and via high-voltage switches 13*a* to 13*n*. High-voltage switches 13*a* to 13*n* are once again configured as light-triggered flip-flop diodes, and each have a light-controlled switch 13"*a* to 13'*n* and a high-voltage flip-flop diode which represents an overhead-switched switch 13'*a* to 13'*n*. Switches 13*a* to 13*n* used in the circuit depicted in FIG. 3 are nonconductive in the reverse direction.

The polarization of the diodes of high-voltage switches 13*a* to 13*n* is the reverse of the exemplifying embodiment depicted in FIG. 2. The anodes of light-controlled switches 13"*a* to 13"*n* are thus connected via connecting path 15 to high-voltage output 11, while the cathodes of overhead-switching switches 13'*a* to 13'*n* are connected to spark plugs 3*a* to 3*n*.

Measurement circuit 19', however, differs from the one depicted in FIG. 1 and 2: it comprises, for example, a series circuit made up of a resistor 37, a diode 39, and a resistor 41. Resistor 37 is connected to the primary side of ignition coil 5, specifically in this case to the collector of transistor 9. Connected to the other side of resistor 37 is the anode of diode 39, the cathode of which is connected to resistor 41 and capacitor 42. The end of capacitor 42 opposite resistor 41, at which the voltage proportional to ionization current $I_{ION}$ is picked off, is connected via resistor 44 to ground. At the end of resistor 41 opposite capacitor 42 there is a connection point 23 to which high-voltage switches associated with spark plugs 3*a* to 3*n* (in this case high-voltage diodes 43*a* to 43*n*) are connected; their anodes are connected to connection point 23, and their cathodes to the end of the spark gap of spark plugs 3*a* to 3*n*, to which high-voltage switches 13*a* to 13*n* are also connected. The opposite end of the spark gap of spark plugs 3*a* to 3*n* is grounded.

Measurement circuit 19' causes a positive voltage signal to be applied to spark plugs 3*a* to 3*n* in order to sense ionization current $I_{ION}$. The polarization of high-voltage diodes 43*a* to 43*n* prevents the high voltage applied to spark plugs 3*a* to 3*n* from reaching measurement circuit 19'.

Otherwise the components of inductive ignition device 1" as shown in FIG. 3 correspond to those of the variant embodiment depicted in FIG. 2. Identical parts are given identical reference characters, and reference is made in that context to the description accompanying FIG. 2.

Figure 4:
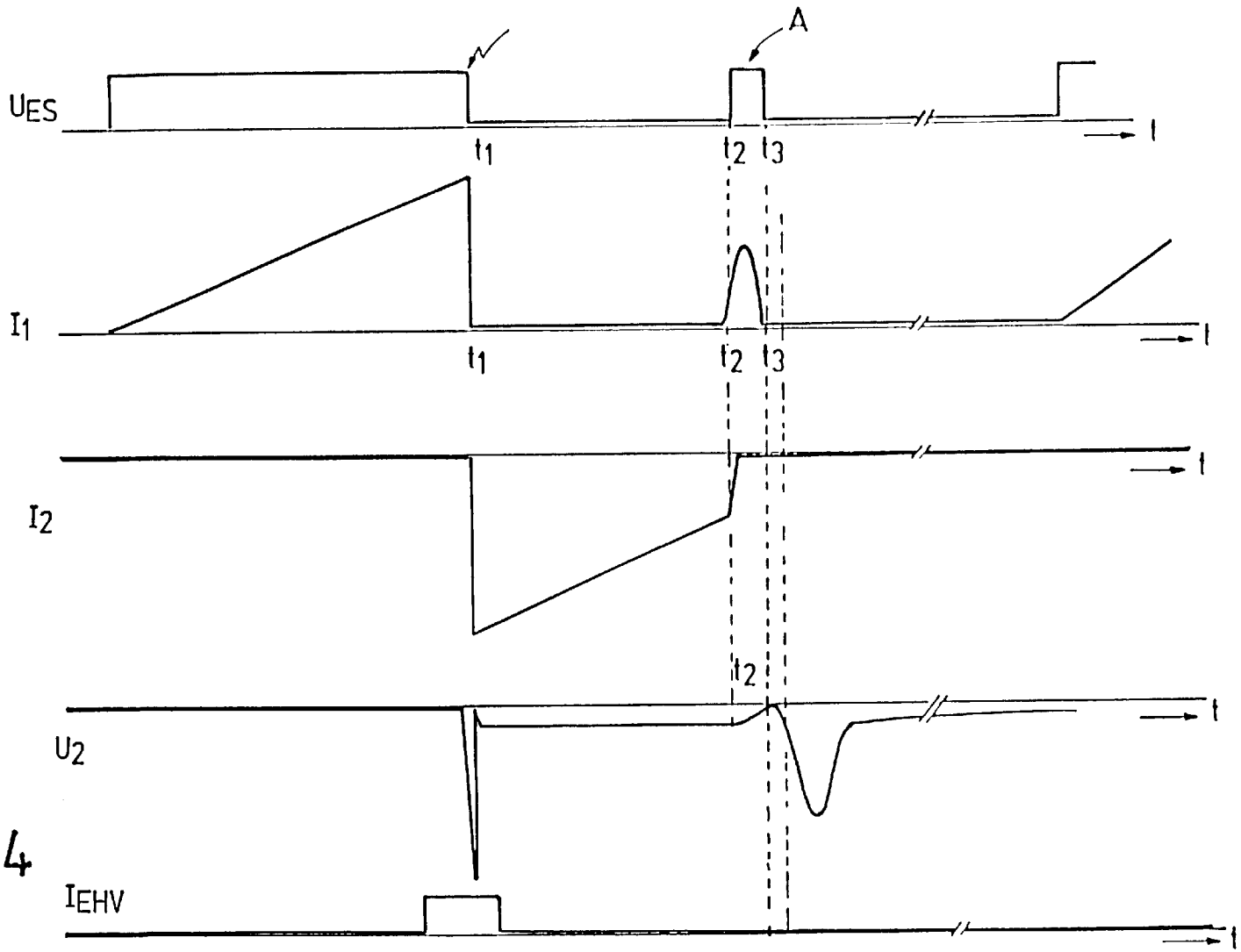
FIG. 4 shows a schematic diagram of typical voltages and currents that can be measured within the inductive ignition devices as shown in FIGS. 1 to 3.

FIG. 4 schematically shows the change in activation voltage $U_{ES}$, applied to the base of transistor 9, over time t; below that the primary current $I_1$ in ignition coil 5 over time, and also the secondary current $I_2$ in ignition coil 5 that is conveyed to the activated spark plugs, and in a fourth partial diagram the secondary voltage $U_2$, present at the spark plugs, over time t. Lastly, the last and bottommost partial diagram in FIG. 4 indicates the current $I_{EHV}$ which serves to activate light-controlled switches 13"*a* to 13"*n* discussed in FIGS. 2 and 3, and thus the electronic high-voltage distributor.

It is evident from the depiction in FIG. 4 that activation voltage $U_{ES}$ is present during the "dwell time" up to time $t_1$, and is switched off at the moment of ignition, indicated by a lightning-bolt symbol. The primary current $I_1$ rises linearly until time $t_1$ and then drops abruptly. Secondary current $I_2$ remains at zero until time $t_1$, and at time $t_1$ rises to its maximum value. At the same time, the peak for ignition voltage $U_2$ occurs at time $t_1$. The desired spark duration extends from time $t_1$ to time $t_2$. It is evident from FIG. 4 that during the period $t_1<=t<=t_2$, secondary current $I_2$ decreases essentially linearly. The high-voltage switches of the inductive ignition devices in FIGS. 1 to 3 can be selected so that the switches switch off at the current value of $I_2$ present at time $t_2$, specifically because the current falls below the "holding current" of said high-voltage switches.

The voltage peak of $U_2$ at time $t_1$ causes high-voltage switch 13, configured as an overhead-switching high-voltage flip-flop diode, of inductive ignition device I as shown in FIG. 1 to become conductive, so that secondary current $I_2$ flows across spark gap 35 of spark plug 3, igniting the spark. The spark is extinguished as soon as the high-voltage switch switches off. This can be accomplished by the fact that the secondary current falls below the holding current value. It is thus possible to ensure, by means of the specific design of the high-voltage switches, that the spark duration is limited. The spark duration can, however, also be limited by the fact that secondary current $I_2$ is forced to switch off, and the current thus falls below the holding current value of the high-voltage switch. The secondary current is switched off by the fact that a second activation signal A, which is depicted in the topmost partial diagram of FIG. 4, causing current $I_1$ to flow again, is issued via the activation circuit at time $t_2$. The second activation signal is maintained for a period of 10 microseconds to 500 microseconds. An activation signal duration of 100 microseconds has proven particularly successful. During this period $t_2 <= t < t_3$, the current $I_1$ rises and then drops back to a value of zero. This forces termination of the current flow $I_2$. The current $I_2$ thus drops, in a defined and forced fashion, to a value which lies below the holding current of the high-voltage switch. After a time period of approximately 50 microseconds that is also referred to as the "recovery time," a voltage can once again be applied in the forward direction to the high-voltage switch.

After the activation signal A switches off at time $t_3$, the secondary voltage $U_2$ rises again briefly and then drops toward zero. A rapid, defined dissipation of the residual energy in the ignition coil takes place here, so that $U_2$ no longer exceeds the inhibiting voltage of the high-voltage switches. The latter thus remain in their switched-off state, so that the spark plugs no longer fire.

The voltage and current profiles indicated in FIG. 4 also occur for the ignition systems depicted in FIGS. 2 and 3.

High-voltage switches 13*a* to 13*n*, configured as light-triggered flip-flop diodes, are switched on by activation of light-controlled switches 13"*a* to 13"*n*. The light-triggered switches thus, in the activated state, enable the connection between the overhead-switching switches and high-voltage output 11, so that overhead-switching switches 13'*a* to 13'*n* can be switched on by overvoltage $U_2$. The overhead-switching switches are enabled by means of a current signal $I_{EHV}$ that is applied, immediately before the occurrence of ignition voltage $U_2$at time $t_1$, to light-controlled switches 13"*a* to 13"*n* of spark plugs 3*a* to 3*n*, to which the energy of ignition coil 5 is to be conveyed. Purely by way of example, it will be assumed that switching signal $I_{EHV}$ is applied to one of light-switchable switches 13"*a* to 13"*n* for 100 microseconds before and after time $t_1$. It is evident that defined termination of the spark duration does not require any further signal $I_{EHV}$ to be applied to the light-switching switches. Light-triggerable switches 13*a* to 13*n*, and high-voltage flip-flop diodes 13'*a* to 13'*n* associated with said switches, are switched off exclusively by means of the second activation signal A applied at time $t_2$, which is depicted in the topmost partial diagram of FIG. 4.

The result of signal $U_{ES}$, in the case of the ignition devices depicted in FIGS. 2 and 3 as well, is therefore that primary current $I_1$ rises again at time $t_2$, so that here again, the secondary current $I_2$ is forced to terminate and—as is evident from FIG. 4—drops approximately 20 mA in 50 microseconds, so that the spark duration is forced to terminate. In the case of the variant embodiments as shown in FIGS. 2 and 3 as well, the secondary voltage $U_2$ will rise again when the second activation signal $U_{ES}$ is switched off at time $t_3$—but without reaching the inhibiting voltage of overhead-switching switches 13'*a* to 13'*n*—and then decrease toward zero. The residual energy in the spark plug is thus rapidly dissipated, but without firing the spark plugs again.

The circuits depicted in FIGS. 1 to 3 are thus characterized by the fact that the spark duration can be deliberately shortened. This is made possible on the one hand by the use of high-voltage switches—whether those depicted in FIG. 1 or those explained with reference to FIGS. 2 and 3—whose holding current is selected so that secondary current 12 is switched on at time $t_2$ because the current has fallen below the holding current of the high-voltage switches.

Essentially reliable operation of the circuits results if the secondary current $I_2$ is deliberately switched off by a second activation signal A that is generated at time $t_2$ and sent to the ignition coil. As described above, the second activation signal at time $t_2$ decreases the secondary current $I_2$ in defined fashion to zero, so that the high-voltage switches are definitively switched off and remain switched off after a certain period (recovery time).

Because the high-voltage switches are switched off, the spark plugs are decoupled from the ignition coil, so that even when the secondary voltage $U_2$ rises after time $t_3$, refiring of the plugs is impossible.

These explanations indicate on the one hand the operation of the inductive ignition devices as shown in FIGS. 1 to 3, and on the other hand the method for activating a spark plug of an internal combustion engine by means of an inductive ignition device which is characterized precisely by the fact that in order to implement a defined spark duration for a spark plug, two activation signals are generated. The first activation signal serves to initiate the ignition operation at time $t_1$; the purpose of the second activation signal A, issued at time $t_2$, is to switch off the secondary current in the spark plug in defined fashion and thus limit the spark duration. It has been found that the second activation signal must be made available for a period of, preferably, 100 microseconds, so that on the one hand the recovery time for the high-voltage switches being used is observed. On the other hand, the short duration of the second activation signal ensures that when the primary current $I_1$ is switched off, the secondary current $I_2$ does not rise again at time $t_3$.

Because of the specific embodiment of the circuits of FIGS. 1 to 3, and the design of the method, a measurement current can be applied to the spark plugs, in which context measurement circuits 19 and 19', which were depicted and explained in FIGS. 1–2 and 3, respectively, can be used. The measurement current which flows across the spark gap of the spark plug is analyzed while the ignition spark is no longer active. It flows because of the ions present in the combustion chamber during combustion. With this method, also referred to as ionization current measurement, the combustion process can be monitored. The measurement current lies within a range from 20 microamperes to 200 microamperes Preferably a measurement current of 50 microamperes to 100 microamperes is selected. From the explanations with reference to the high-voltage switches used in FIGS. 1 and 2, it is clear that reverse-conducting flip-flop diodes, i.e. reverse-conducting high-voltage diodes or reverse-conducting light-triggered flip-flop diodes, are used to perform the ionization current measurement, so that the ionization current measurement can be performed with relatively little effort. If, as explained with reference to FIG. 1, single spark coils are used, it is possible to provide a separate measurement circuit for each spark plug. It is also possible to use a single measurement circuit for a plurality of spark plugs, for example four.

In FIG. 3, high-voltage switches which are nonconductive in the reverse direction are used. The measurement circuit depicted in FIG. 3 is also usable for arrangements as defined in FIG. 1; high-voltage switches 13 as defined in FIG. 1 are then configured to be nonconductive in the reverse direction.

It is evident from the statements above that in the case of the inductive ignition devices shown in FIGS. 1 to 3, ionization current measurement is possible with no need to reduce the available voltage sent to the spark plugs or the secondary initial current $I_2$. Because the secondary current is "switched off" in defined fashion, a high energy in the ignition coil can be sent to the plugs, so that sufficient voltage and energy are available under all operating conditions.

Deliberate switching off of the high-voltage switches, either by means of a specific definition of the holding current of the high-voltage switches or, preferably by means of a second activation signal, ensures that elevated power dissipation cannot occur in the output stage activation system or the spark plug.

The fact that the high-voltage switch is made nonconductive means the energy remaining in the ignition coil can decay with a short time constant without allowing refiring of the spark plugs. Lastly, deliberate termination of the spark duration can prevent residual energy operation in multiple-cylinder engines, for example in engines with more than five cylinders, at high engine speed and when activation is being provided by only one output stage. In this context, for a given energy a relatively low initial current can be selected for the spark plugs, resulting in a correspondingly long spark duration. The low initial value of the secondary current $I_2$ results in relatively little plug wear. This operating mode can be implemented, in particular, in conjunction with an electronic high-voltage distributor, as was explained with reference to FIGS. 2 and 3.

What is claimed is:

1. An inductive ignition device for at least one spark plug of an internal combustion engine, comprising:

at least one activation circuit for activating at least one ignition coil; and a high-voltage switch associated with the at least one spark plug, wherein the high-voltage switch conducts a spark current of the at least one spark plug when activated into a conductive, switched-on state by a first activation signal emitted by the at least one activation circuit, the high-voltage switch remaining in the switched-on state until the spark current falls below a holding current value, and wherein the at least one activation circuit emits a second activation signal for terminating the spark current.

2. The ignition device according to claim 1, wherein the second activation signal generates no further spark current and causes the high-voltage switch to remain in a switched-off state after a recovery time.

3. The ignition device according to claim 2, wherein the second activation signal is emitted for a period of time between 10 microseconds and 500 microseconds.

4. The ignition device according to claim 2, wherein the second activation signal is emitted for a period of 100 microseconds.

5. The ignition device according to claim 1, wherein the high-voltage switch is arranged between a high-voltage output on a secondary side of the at least one ignition coil and the at least one spark plug.

6. The ignition device according to claim 1, wherein the high-voltage switch includes a flip-flop diode configuration.

7. The ignition device according to claim 1, wherein the high-voltage switch includes a triggerable configuration.

8. The ignition device according to claim 1, wherein the high-voltage switch includes a reverse-conducting high-voltage flip-flop diode.

9. The ignition device according to claim 1, wherein the high-voltage switch includes a reverse-conducting light-triggered flip-flop diode.

10. The ignition device according to claim 1, further comprising a measurement circuit for sensing an ionization current and applying a measurement current to the at least one spark plug.

11. The ignition device according to claim 10, wherein the measurement circuit includes:

a Zener diode, a series arrangement coupled in parallel to the Zener diode and including a capacitor arranged in series with respect to a diode, and a resistor coupled in parallel to the diode.

12. The ignition device according to claim 10, wherein the measurement circuit includes:

a first series arrangement coupled to the at least one ignition coil and including a first resistor arranged in series with respect to a diode, and a second series arrangement coupled to the first series arrangement and to the high-voltage switch, the second series arrangement including a second resistor, a capacitor, and a third resistor arranged in series with respect to each other.

13. A method for activating a spark plug of an internal combustion engine using an inductive ignition device, comprising the steps of:

generating a first activation signal serving to create an ignition spark; and generating a second activation signal for terminating the ignition spark by switching off a secondary current, thereby defining an ignition spark duration for the spark plug.

14. The method according to claim 13, wherein the second activation signal switches off a high-speed switch conducting a spark current to the spark plug.

15. The method according to claim 13, wherein the second activation signal is generated for a period of time between 10 microseconds and 500 microseconds.

16. The method according to claim 13, wherein the second activation signal is generated for a period of 100 microseconds.

17. The method according to claim 13, further comprising the steps of:

applying a measurement voltage to the spark plug; and monitoring a combustion process of the internal combustion engine using an ionization current measurement.

18. The method according to claim 17, wherein the measurement voltage is in a range of 100 V to 500 V.

19. The method according to claim 17, wherein the measurement voltage is in a range of 200 V to 300 V.

* * * * *